US011732665B1

(12) United States Patent
Matsui et al.

(10) Patent No.: US 11,732,665 B1
(45) Date of Patent: Aug. 22, 2023

(54) CONTROL APPARATUS FOR INTERNAL COMBUSTION ENGINE

(71) Applicant: HONDA MOTOR CO., LTD., Tokyo (JP)

(72) Inventors: Ken Matsui, Tokyo (JP); Satoshi Sekiguchi, Tokyo (JP); Takahiro Ohashi, Tokyo (JP); Jyo Ishimasa, Tokyo (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 18/113,120

(22) Filed: Feb. 23, 2023

(30) Foreign Application Priority Data

Mar. 10, 2022 (JP) ..... 2022-037062

(51) Int. Cl.
*F02D 41/00* (2006.01)
*F02D 41/18* (2006.01)
*F02D 41/14* (2006.01)
*F02D 9/02* (2006.01)

(52) U.S. Cl.
CPC ..... *F02D 41/18* (2013.01); *F02D 41/0002* (2013.01); *F02D 41/1401* (2013.01); *F02D 41/185* (2013.01); *F02D 41/187* (2013.01); *F02D 2009/0255* (2013.01); *F02D 2200/0404* (2013.01)

(58) Field of Classification Search
CPC .... F02D 41/0002; F02D 41/18; F02D 41/182; F02D 41/185; F02D 41/187; F02D 2009/0255; F02D 2200/0404; F02D 2250/16
USPC ..... 73/114.32, 114.34; 123/361, 399
See application file for complete search history.

(56) References Cited

U.S. PATENT DOCUMENTS 6,152,118 A * 11/2000 Sasaki ..... F02D 41/3011 60/299
2003/0230287 A1* 12/2003 Ozeki ..... G01M 3/025 73/114.37
2008/0189007 A1* 8/2008 Takamiya ..... F02D 41/0002 701/30.8
2019/0390624 A1 12/2019 Ishimasa et al.

FOREIGN PATENT DOCUMENTS

EP 1512856 A2 * 3/2005 ..... F02D 11/105
JP 6768031 B2 10/2020

* cited by examiner

*Primary Examiner* — Erick R Solis
(74) *Attorney, Agent, or Firm* — Carter, DeLuca & Farrell LLP

(57) ABSTRACT

In the present invention, a clogging rate is calculated using a first flow rate function when the degree of clogging of the throttle valve is in the reference state and a second flow rate function estimated based on the intake air volume. For each predetermined period, sample points, which are combinations of the second flow rate function and throttle valve position, are obtained, and the learning points are calculated by averaging a plurality of sample points for each predetermined position range. Based on the plurality of learning points, coefficients a to c of the approximate function of the second flow rate function characteristic are calculated by the least-squares method, and the clogging rate is calculated based on the second flow rate function characteristic and the first flow rate function approximated by the approximate function using the coefficients a to c.

8 Claims, 16 Drawing Sheets

FLOW RATE FUNCTION KTH
KTH AT MAXIMUM CLOGGING
RANGE n
KTH WHEN NEW
LEARNING POINT
0
TH
NUMBER OF SAMPLE POINTS
9
7
8
0

FLOW RATE FUNCTION KTH
KTH AT MAXIMUM CLOGGING
REPLENISHED LEARNING POINT
KTH WHEN NEW
0
TH
CLOGGING 1 RATE KTHC
0

FLOW RATE FUNCTION KTH
APPROXIMATE FUNCTION AT CURRENT D/C
KTH=aTH²+bTH+c
KTH WHEN NEW
KTH AT MAXIMUM CLOGGING
0
TH

NEXT D/C

CONTROL APPARATUS FOR INTERNAL COMBUSTION ENGINE

BACKGROUND

Technical Field

The present invention relates to a control apparatus for an internal combustion engine, and more particularly to a control apparatus for controlling an internal combustion engine according to the degree of throttle valve clogging.

Related Art

As a conventional control apparatus for an internal combustion engine, the one disclosed in, for example, Japanese Patent No. 6768031 is known. In this control apparatus, the throttle valve clogging rate is calculated and learned during operation of the internal combustion engine as a parameter representing the degree of clogging of deposits in the throttle valve opening (hereinafter referred to as "degree of throttle valve clogging"), and is used to control intake air volume and others. Therefore, accurate learning of the clogging rate is important to improve fuel efficiency and energy efficiency.

The method for calculating and learning the throttle valve clogging rate in Japanese Patent No. 6768031 is as follows. First, during idle operation of the internal combustion engine, estimated KTH, which is an estimate of the actual flow rate function (KTH), is calculated every predetermined time based on, for example, the intake air volume detected by an air flow meter, and stored as sample points together with the throttle valve position. When the operation of the internal combustion engine is terminated, a representative point 1 representing the estimated KTH is calculated by applying the least-squares method to the plurality of stored sample points for each predetermined position range of the throttle valve. Next, a representative point 2 is calculated for each position range by weighted average of the representative point 1 and the representative point obtained in the previous operation cycle. Then, an approximate function representing the relationship of the estimated KTH with the throttle valve position is obtained by applying the least-squares method to the plurality of calculated representative points 2.

On the other hand, KTH when the throttle is new, which is the flow rate function when the throttle valve has no deposits at all, and KTH when the throttle is clogged to the maximum, which is the flow rate function when the throttle valve has maximum deposits, are set in advance over all position ranges of the throttle valve as other flow rate functions that are used as the reference for calculating the throttle valve clogging rate. Then, the clogging rate is newly calculated and learned from the relationship between the KTHs when new and at maximum clogging and the estimated KTH calculated for the current operation cycle. The clogging rate learned as described above is used to control the internal combustion engine, for example, to set the target position of the throttle valve.

SUMMARY

In the conventional control apparatus described above, all estimated KTHs calculated at each predetermined time during operation of the internal combustion engine are stored as sample points, and at the end of operation of the internal combustion engine, the least-squares method is applied to a large number of stored sample points to calculate the representative point 1. As a result, the memory capacity for storing a large number of sample points may become enormous. In addition, it is necessary to calculate the representative point 1 by the least-squares method for each of the position ranges of the throttle valve and to derive an approximate function representing the estimated KTH over all position ranges by the least-squares method, which increases the computational load for this purpose.

The present invention has been made to solve the above problems, and an object of the present invention is to provide a control apparatus for an internal combustion engine capable of accurately learning the degree of throttle valve clogging over a wide position range while reducing the computational load and memory capacity for that purpose, and of improving fuel efficiency and energy efficiency by controlling the internal combustion engine using the learned clogging degree.

In order to achieve this object, a control apparatus for an internal combustion engine according to claim 1 includes: a clogging parameter calculation means that calculates a clogging parameter that represents the degree of clogging (clogging rate KTHC) of a throttle valve 5 using a first flow rate function for a state where the degree of clogging of the throttle valve 5 in an intake air passage 11 of an internal combustion engine 3 is in the reference state (KTH when new and KTH at maximum clogging in the embodiment (hereinafter the same applies to this section)) and a second flow rate function (estimated KTH) estimated based on an intake air volume GAIR detected by an air flow meter 22 (ECU 2, step 8 in FIG. 2, FIG. 12); and a control means that controls the internal combustion engine 3 using the calculated clogging parameter (ECU 2, FIG. 17), in which the clogging parameter calculation means includes: a sample point acquisition means that calculates the second flow rate function and obtains sample points, which are combinations of the second flow rate function and the throttle valve position (throttle valve position TH) of the throttle valve 5, for each predetermined period during operation of the internal combustion engine 3 (ECU 2, step 1 in FIG. 2); a learning point calculation means that calculates learning points for each of a plurality of predetermined position ranges of the throttle valve 5 by averaging the plurality of sample points belonging to the position ranges (ECU 2, step 20 in FIG. 5, FIG. 8); and a coefficient calculation means that calculates coefficients a to c of an approximate function (equation (8)) of a predetermined polynomial equation for approximating a second flow rate function characteristic (estimated KTH characteristic), which represents the relationship of the second flow rate function with the position of the throttle valve 5, by the least-squares method based on the plurality of learning points calculated for each of the plurality of position ranges (ECU 2, step 7 in FIG. 2, step 41 in FIG. 10), and the control apparatus calculates the clogging parameter based on the second flow rate function characteristic approximated by the approximate function using the calculated coefficients a to c and on the first flow rate function (equation (2)).

In this control apparatus, a clogging parameter representing the degree of throttle valve clogging is calculated using a first flow rate function (flow rate function when the degree of throttle valve clogging is in the reference state) and the second flow rate function (flow rate function estimated based on the intake air volume detected by the air flow meter), and the internal combustion engine is controlled according to the clogging parameter.

The clogging parameter is calculated as follows. First, a sample point acquisition means calculates the second flow rate function and obtains sample points, which are the combination of the second flow rate function and throttle valve position, at each predetermined period during operation of the internal combustion engine. Next, a learning point calculation means calculates learning points by averaging the plurality of the sample points belonging to each of a predetermined plurality of position ranges of the throttle valve. Next, a coefficient calculation means calculates the coefficient using the least-squares method based on the plurality of learning points calculated for the plurality of position ranges. This coefficient defines an approximate function of a predetermined polynomial equation for approximating the second flow rate function characteristic, which represents the relationship of the second flow rate function with the position of the throttle valve. The clogging parameter is then calculated based on the second flow rate function characteristic, which is approximated by an approximate function using the calculated coefficient, and the first flow rate function.

As described above, according to claim 1, the learning points are calculated by averaging a plurality of sample points for each of a predetermined plurality of throttle valve position ranges. As a result, the computational load and memory capacity can be reduced compared to the conventional case where the representative point 1 of the estimated KTH is calculated by the least-squares method for each position range. In addition, the coefficient of the approximate function of a polynomial equation that approximates the second flow rate function characteristic is calculated by the least-squares method based on the plurality of learning points calculated for each of the plurality of position ranges of the throttle valve, and the clogging parameter is calculated based on the second flow rate function characteristic and the first flow rate function thus approximated. As a result, the clogging rate of the throttle valve can be accurately learned over a wide position range.

The invention according to claim 2 is the control apparatus for an internal combustion engine according to claim 1, in which the learning point calculation means calculates the learning points by sequentially averaging the plurality of sample points each time the sample point is obtained (step 20 in FIG. 5, FIG. 8).

According to this configuration, the learning points are calculated by sequentially averaging the plurality of sample points each time a sample point is obtained. In this sequential averaging, when the number of sample points up to the previous sample point is n, the average value up to the previous sample point is xave(n), and the sample point this time is x(n+1), the current average value xave(n+1) is calculated by the following equation (1) each time a sample point is obtained.

$$xave(n+1)=(n\cdot xave(n)+x(n+1))/(n+1) \quad (1)$$

As described above, in the case of sequential averaging, the data required to calculate the average value xave(n+1) is only the number of sample points n and the average value xave(n) up to the previous time, in addition to the current sample points x(n+1), and it is only necessary to sequentially store the number of sample points n and the average value xave(n) regardless of the number of sample points. As a result, the memory capacity can be greatly reduced compared to the conventional case where a large number of sample points are all stored and averaged together.

The invention according to claim 3 is the control apparatus for an internal combustion engine according to claim 2, in which the learning point calculation means calculates the learning points in a normal operation mode of the internal combustion engine 3 (step 5 in FIG. 2), the coefficient calculation means calculates the coefficients of the approximate function based on the calculated plurality of learning points in a right-after-stop mode (step 7 in FIG. 2), the clogging parameter calculation means calculates the clogging parameter based on the approximate function using the calculated coefficients in the next initial operation mode (step 8 in FIG. 2), and the control means controls the internal combustion engine 3 using the clogging parameter in the next normal operation mode.

According to this configuration, the calculation of the learning points, calculation of the coefficient of the approximate function, calculation of the clogging parameter, and control of the internal combustion engine are executed in the normal operation mode, right-after-stop mode, next initial operation mode, and normal operation mode of the internal combustion engine, respectively. As a result, the processing load can be reduced by distributing and executing these calculation and control processes in each operating mode. In addition, the only data that needs to be passed between the operation modes of the internal combustion engine are basically: a plurality of learning points for each position range of the throttle valve position between the normal operation mode and right-after-stop mode; the coefficients of the approximate function between the right-after-stop mode and next initial operation mode; and the clogging parameter between the initial and normal operation modes. Therefore, these data can be easily stored and passed on with a very small memory capacity.

The invention according to claim 4 is the control apparatus for an internal combustion engine according to claim 1, in which the learning point calculation means calculates the learning point for each operation cycle of the internal combustion engine 3, and, when there is a position range of the throttle valve for which the number of sample points obtained in a current operation cycle is less than a predetermined value, the coefficient calculation means uses the learning points calculated in a previous operation cycle as the learning points for the position range to calculate the coefficients of the approximate function (step 40 in FIG. 10, FIGS. 11A to 11C).

In this configuration, the calculation of the learning points is executed for each operation cycle of the internal combustion engine. Therefore, when only idle operation is performed or the operation time is short, few sample points may be obtained in a certain position range of the throttle valve. In such cases, when the learning points for that certain position range are calculated from a small number of sample points, the low accuracy of the learning points may decrease the accuracy of the approximate function calculated based on a plurality of learning points including the above learning points. Alternatively, when the approximate function is calculated based only on a plurality of learning points in other position ranges, assuming that there are no learning points in that certain position range, the accuracy of the approximate function may still be decreased due to the low accuracy of the approximation. On the other hand, since clogging of the throttle valve is caused by accumulation of deposits, the degree of clogging usually does not change rapidly.

From such a viewpoint, according to the present invention, when there is a throttle valve position range for which the number of sample points obtained in the current operation cycle is less than a predetermined value, the coefficient of the approximate function is calculated using the learning points calculated in the previous operation cycle as the learning points for that position range because a sufficient number of sample points have not been obtained. As a result, accuracy of the approximation by the approximate function based on a plurality of learning points and the learning accuracy of the clogging parameter based on the approximate function can be favorably maintained.

The invention according to claim 5 is the control apparatus for an internal combustion engine according to claim 4, in which, when there is a lower or higher position range of the throttle valve 5 that is not used during operation of the internal combustion engine 3, the clogging parameter calculation means sets the lower or higher position range as a learning prohibited range where learning of the clogging parameter is prohibited, and sets the clogging parameter in the learning prohibited range to the same value as the clogging parameter calculated in the position range adjacent to the learning prohibited range (step 6 in FIG. 2, step 58 in FIG. 12, and FIG. 15).

Depending on the operating conditions of the internal combustion engine and other factors, the lower or higher position range of the throttle valve may be rarely used. For example, as the throttle valve is used and clogging progresses, the throttle valve position is controlled to gradually shift toward a higher position, thus resulting in zero sample points in the low position range. In this case, when an approximate function is used to approximate all position ranges of the throttle valve using the learning points obtained in other position range, the accuracy of approximation in the other position range may be affected by low position ranges without learning points.

From such a viewpoint, according to the present invention, when there is a lower or higher position range of the throttle valve that is not used during operation of the internal combustion engine, the lower or higher position range is set as a learning prohibited range where learning of clogging parameters is prohibited. As a result, the learning accuracy of the clogging parameters can be favorably maintained by performing approximation by the approximate function only in the learning permitted range using the learning points obtained in the position range other than the learning prohibited range (hereinafter referred to as the "learning permitted range"). The clogging parameter for the learning prohibited range can be set without any trouble by setting the same value as the clogging parameter calculated in the position range adjacent to the learning prohibited range.

The invention according to claim 6 is the control apparatus for an internal combustion engine according to claim 1, in which, when the second flow rate function characteristic approximated by the approximate function has a downward portion, the clogging parameter calculation means corrects the downward portion to be upward (step 57 in FIG. 12, FIG. 14).

Since the second flow rate function characteristic represents the relationship of the second flow rate function with the throttle valve position, it is inherently upward (increases as the throttle valve position increases). For example, in a case where the target throttle valve position is obtained based on the second flow rate function characteristic, when the second flow rate function characteristic is downward (the estimated KTH decreases as the TH position increases), control hunting occurs, such as the existence of a plurality of solutions for the target throttle valve position.

From such a viewpoint, according to the present invention, when the second flow rate function characteristic approximated by the approximate function has a downward portion, this downward portion is corrected to be upward. As a result, the second flow rate function characteristic is properly upward and the above-described control hunting can be avoided.

The invention according to claim 7 is the control apparatus for an internal combustion engine according to claim 1, in which the sample point acquisition means corrects the calculated second flow rate function based on a predetermined reference speed #NEKTC, and then obtains it as the sample point (step 11 in FIG. 5, FIGS. 6A and 6B).

The second flow rate function varies according to the RPM of the internal combustion engine. The higher the RPM, the larger the second flow rate function. Considering this characteristic, according to the present invention, the calculated second flow rate function is corrected based on a predetermined reference RPM, and then obtained as a sample point. This correction allows the second flow rate function calculated under different RPMs of the internal combustion engine to be uniformly converted to values at the reference RPM, thereby providing good compensation for variations in the second flow rate function due to RPM.

The invention according to claim 8 is the control apparatus for an internal combustion engine according to claim 1, further including a peeling determination means (ECU 2, step 60 in FIG. 12) that determines whether or not peeling of deposits from the throttle valve 5 has occurred, in which the clogging parameter calculation means corrects the clogging parameter uniformly to the decreasing side, regardless of the position of the throttle valve 5, when it is determined that peeling has occurred (step 61 in FIG. 12, FIGS. 16A and 16B).

When peeling of deposits from the throttle valve occurs, the second flow rate function increases rapidly and the degree of throttle valve clogging decreases rapidly at all positions. In consideration of this characteristic, according to the present invention, when it is determined that peeling from the throttle valve has occurred, the clogging parameter is corrected uniformly to the decreasing side, regardless of the throttle valve position. As a result, the clogging parameter can be appropriately corrected in response to the peeling of deposits from the throttle valve.

DETAILED DESCRIPTION

Figure 1:
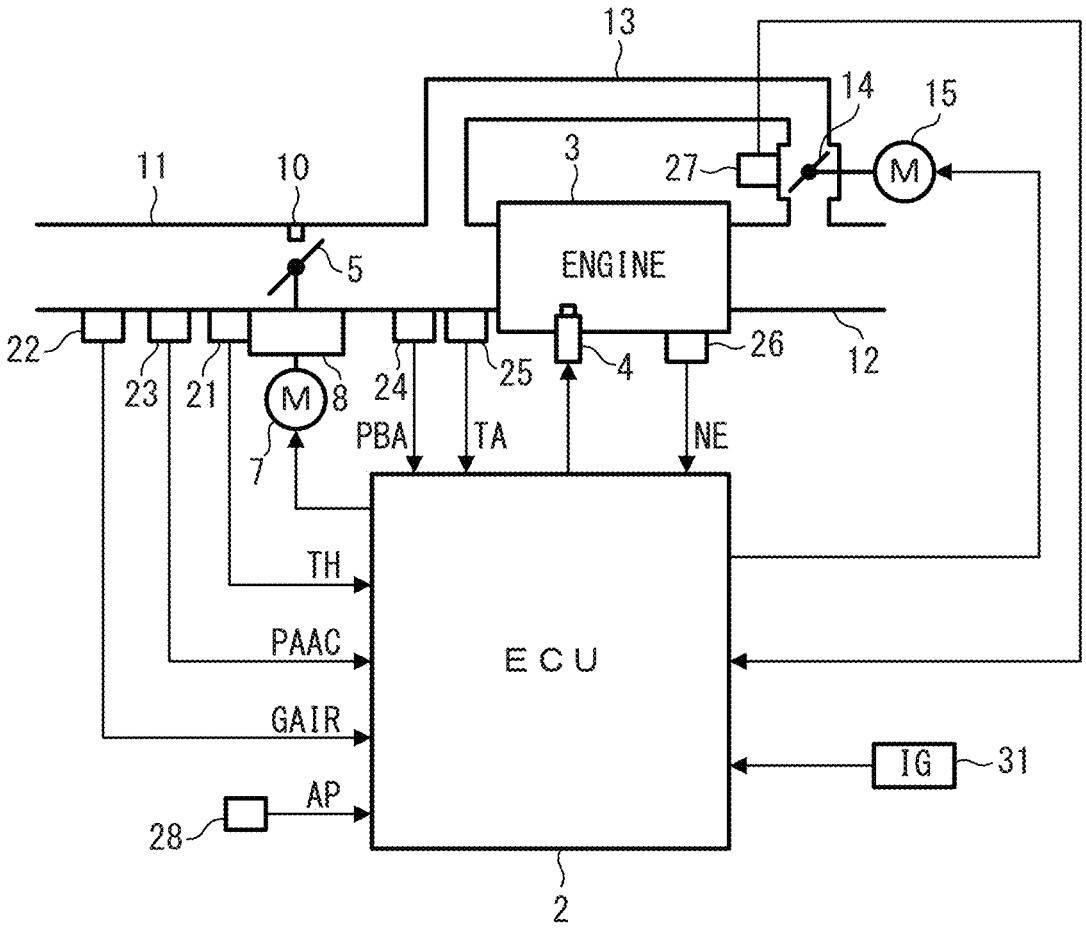
FIG. 1 is a diagram schematically illustrating an internal combustion engine and a control apparatus to which the present invention is applied.

Hereinafter, preferred embodiments of the present invention will be described in detail with reference to the drawings. The internal combustion engine (hereinafter referred to as "engine") 3 illustrated in FIG. 1 is mounted as a power source in, for example, a vehicle (not illustrated), and has a plurality of cylinders (not illustrated). The engine 3 includes a fuel injection valve 4 that injects fuel, an intake air passage 11 through which air (fresh air) flows, an exhaust passage 12 through which exhaust gas flows, and an EGR passage 13 through which a portion of the exhaust gas returns to the intake air passage 11 as EGR gas.

The intake air passage 11 is connected to each cylinder of the engine 3 via a plurality of branches of an intake manifold. The exhaust passage 12 is connected to each cylinder of the engine 3 through a plurality of branches of an exhaust manifold. The EGR passage 13 bypasses the cylinders of the engine 3 and is connected to the intake air passage 11 and the exhaust passage 12.

The EGR passage 13 is provided with an EGR valve 14. The EGR valve 14 is connected to an EGR motor 15 including, for example, a DC motor. The position of the EGR valve 14 is controlled by adjusting the duty ratio of the drive current supplied to the EGR motor 15 by an electronic control unit (ECU) 2 to be described later, thereby controlling the flow rate of the EGR gas.

A rotatable throttle valve 5 is provided in the intake air passage 11. The throttle valve 5 is connected to a TH motor 7 as an actuator via a drive mechanism 8. The drive mechanism 8 is a combination of a plurality of gears (not illustrated). The TH motor 7 includes, for example, a DC motor. The position of the throttle valve 5 is controlled by adjusting the duty ratio of the drive current supplied to the TH motor 7 by the ECU 2, thereby controlling the intake air volume drawn into the cylinders of the engine 3.

The intake air passage 11 is provided with a stopper 10 to restrict the throttle valve 5 from turning to the closing side. The position of the throttle valve 5 in contact with the stopper 10 is the fully closed position of the throttle valve 5. When the TH motor 7 is not driven, the throttle valve 5 is positioned at a slightly open position from the fully closed position.

The throttle valve 5 is provided with a throttle valve position sensor 21, and an air flow meter 22 is provided upstream of the throttle valve 5 in the intake air passage 11. The throttle valve position sensor 21 detects the position (throttle valve position) TH of the throttle valve 5 and outputs the detection signal to the ECU 2. The air flow meter 22 detects the flow rate of air flowing through the intake air passage 11 as the intake air volume GAIR and outputs the detection signal to the ECU 2. Based on the input intake air volume GAIR, the ECU 2 calculates the average value of the intake air volume, GAIRAVE.

A first pressure sensor 23 is provided upstream of the throttle valve 5, and a second pressure sensor 24 and an intake air temperature sensor 25 are provided downstream of the throttle valve 5. The first and second pressure sensors 23 and 24 detect the pressure in the intake air passage 11 upstream and downstream of the throttle valve 5 as pre-throttle pressure PAAC and intake manifold pressure PBA, respectively. The intake air temperature sensor 25 detects the temperature (intake air temperature) TA in the intake air passage 11 downstream of the throttle valve 5. These detection signals are input to the ECU 2.

Further, the ECU 2 receives a detection signal representing the RPM of the engine 3 (hereinafter referred to as "engine speed") NE from an RPM sensor 26, a detection signal representing the position of the EGR valve 14 from the EGR valve position sensor 27, and a detection signal representing the position (gas pedal position) AP of an accelerator pedal (not illustrated) of the vehicle from an accelerator position sensor 28.

The ECU 2 includes a microcomputer including a CPU, a RAM, a ROM, an EEPROM, and input/output interfaces (all not illustrated), and is configured to operate during operation of the engine 3 when an IG (ignition) switch 31 is in the ON state, and immediately after the engine 3 is stopped when the IG switch 31 is turned OFF. The above RAM has a ring buffer for storing sample points.

The ECU 2 executes engine control, including control of fuel injection by the fuel injection valve 4 and intake air volume by the throttle valve 5, according to the control program stored in the ROM according to detection signals from the various sensors 21 to 28 described above. In particular, the present embodiment calculates (learns) the clogging rate KTHC of the throttle valve 5 for each operation cycle of the engine 3 as a clogging parameter that represents the degree of clogging of deposits at the opening of the throttle valve 5, and executes engine control such as setting the target throttle valve position according to the calculated clogging rate KTHC. In the present embodiment, the ECU 2 constitutes the clogging parameter calculation means, control means, sample point acquisition means, learning point calculation means, coefficient calculation means, and peeling determination means.

Figure 2:
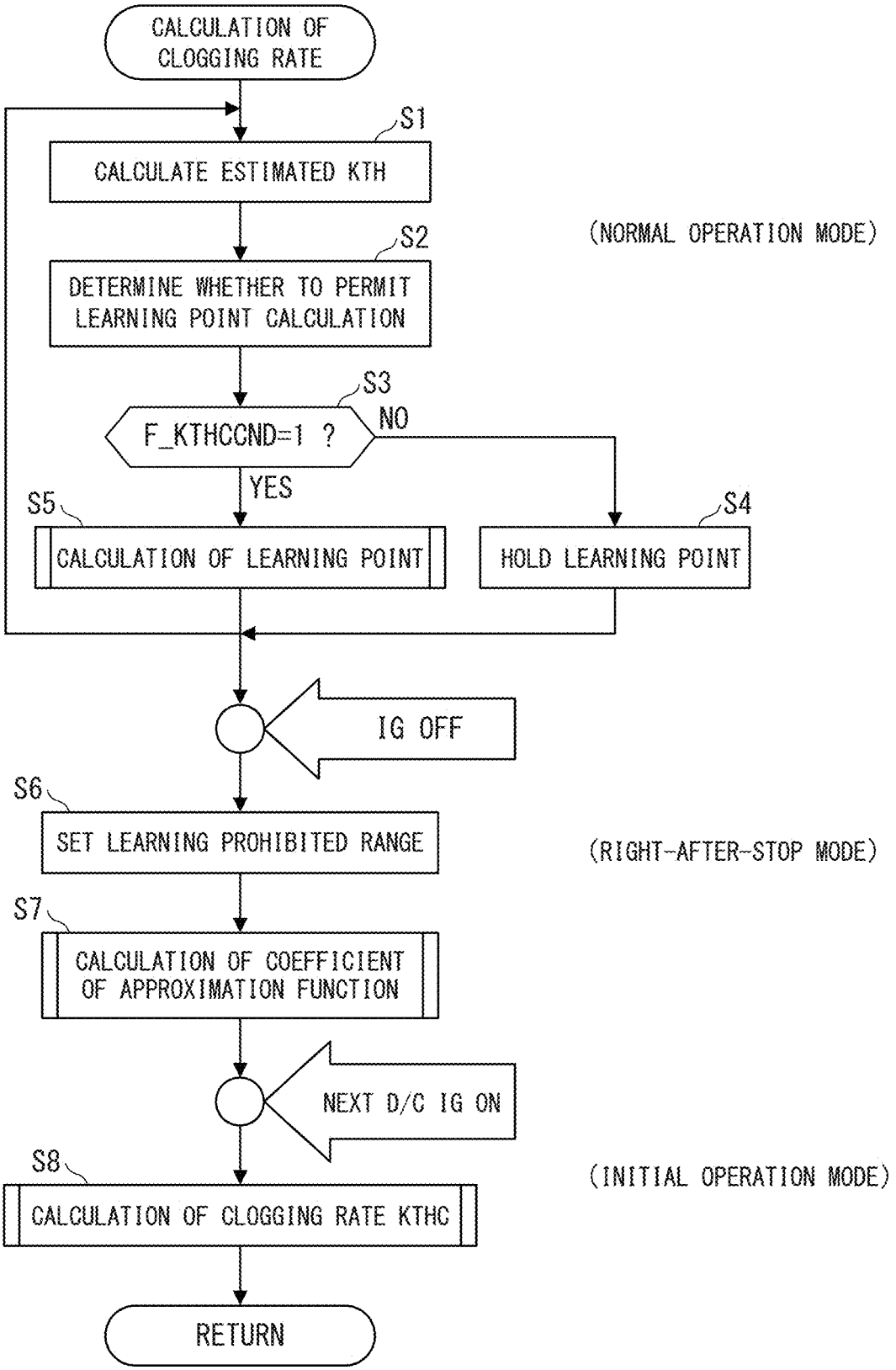
FIG. 2 is a flowchart illustrating the process of calculating the throttle valve clogging rate.

FIG. 2 illustrates the process of calculating the clogging rate KTHC of the throttle valve 5. As illustrated in the drawing, the present process is executed as a series of cycles: the normal operation period of the engine 3 (normal operation mode), the period immediately after the IG switch 31 is turned off and the engine 3 is stopped (right-after-stop mode), and the initial period after the IG switch 31 is turned on for the next operation cycle of the engine 3 (initial operation mode).

The processes of steps 1 to 4 (S1 to S4) in the normal operation mode are repeatedly executed at predetermined time intervals. First, in step 1, the estimated KTH is calculated. This estimated KTH is obtained by estimating the actual flow rate function at the throttle valve 5 as the second flow rate function, and is calculated by applying the detected average intake air volume GAIRAVE, pre-throttle pressure PAAC, intake manifold pressure PBA, and intake air temperature TA to a known nozzle equation. The calculated estimated KTH is combined with the throttle valve position TH at that time and stored as the sample point (TH, estimated KTH).

In the present embodiment, in addition to the estimated KTH, KTH when new and KTH at maximum clogging are used as the first flow rate function as a basis for calculating the clogging rate KTHC of the throttle valve 5. The KTH when new is the flow rate function under conditions where no deposits are deposited at the opening of the throttle valve 5, and the KTH at maximum clogging is the flow rate function under conditions where maximum deposits are deposited at the opening of the throttle valve 5. The KTH when new and the KTH at maximum clogging are mapped in advance (not illustrated) according to the throttle valve position TH and the engine speed NE by experiments or the like, and stored in the ROM.

The clogging rate KTHC of the throttle valve 5 is calculated by the following equation (2) using these three flow rate functions (KTH).

$$KTHC=(\text{estimated } KTH-KTH \text{ when new})/(KTH \text{ at maximum clogging}-KTH \text{ when new}) \quad (2)$$

Figure 3:
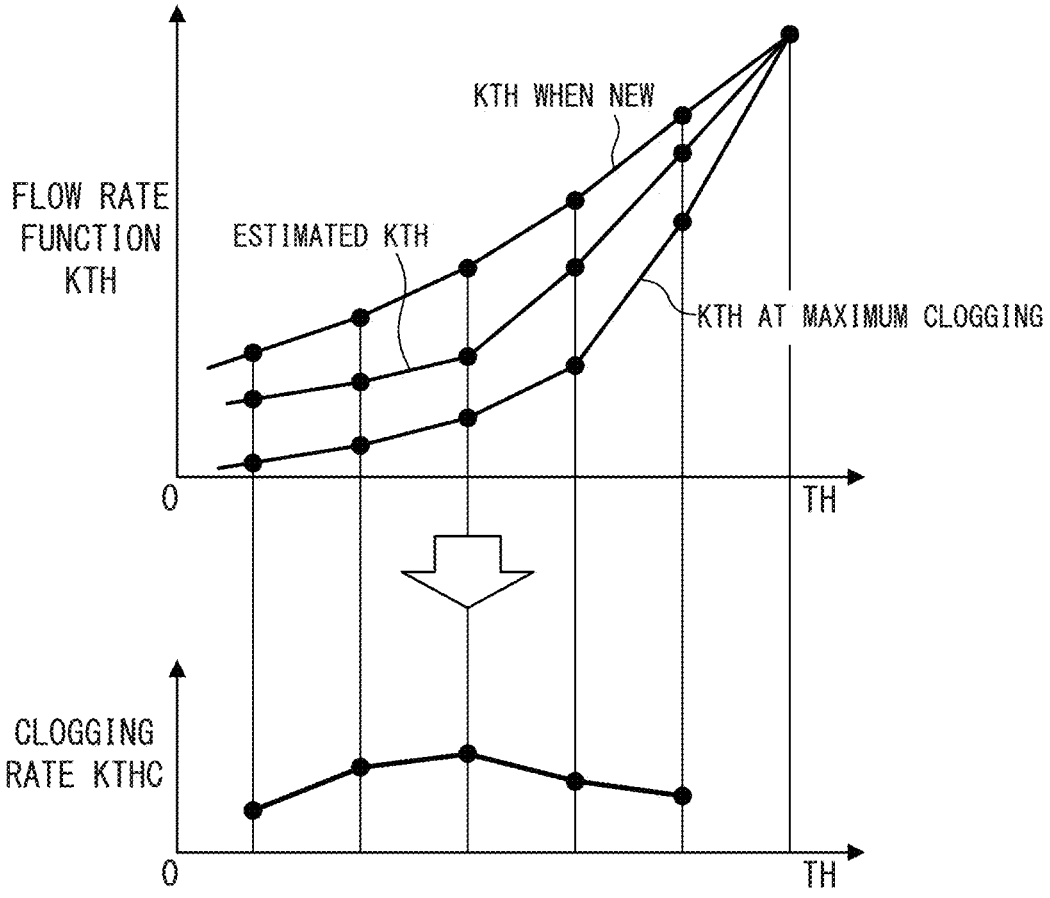
FIG. 3 illustrates the relationship between estimated KTH, KTH when new, KTH at maximum clogging, and clogging rate.

The relationship between these four parameters is illustrated in FIG. 3.

Returning to FIG. 2, in step 2 following step 1, the determination to permit learning of the clogging rate KTHC is made. As will be described later, the learning of the clogging rate KTHC (hereinafter referred to as "clogging learning") is executed by calculating one learning point that is representative of a plurality of sample points for each range of the throttle valve position TH (hereinafter referred to as "TH range") based on a plurality of sample points obtained in step 1 (see FIG. 4), followed by calculating the coefficients of the approximate function that approximates these learning points, and calculating the clogging rate KTHC based on the estimated KTH characteristic approximated by the approximate function and the above equation (2).

In the determination in step 2, when the following learning conditions A to E are all satisfied, clogging learning is permitted and the learning permission flag F_KTHCCND is set to "1".

A. Front/rear pressure ratio of the throttle valve 5 (=intake manifold pressure PBA/pre-throttle valve pressure PAAC) is equal to or less than a predetermined value.

B. Throttle valve position TH is equal to or less than a predetermined position.

C. The air flow meter 22 is activated.

D. The engine speed NE is equal to or less than a predetermined RPM.

E. The state in which the change in the estimated KTH (absolute value of the difference between the current and previous values of the estimated KTH) is equal to or less than a predetermined value continues for a predetermined time.

Next, in step 3, it is determined whether or not the learning permission flag F_KTHCCND is "1". When the answer is NO and clogging learning is not permitted, no new calculation of the learning points is executed and the learning points are held at the previous learning points (step 4).

Figure 5:
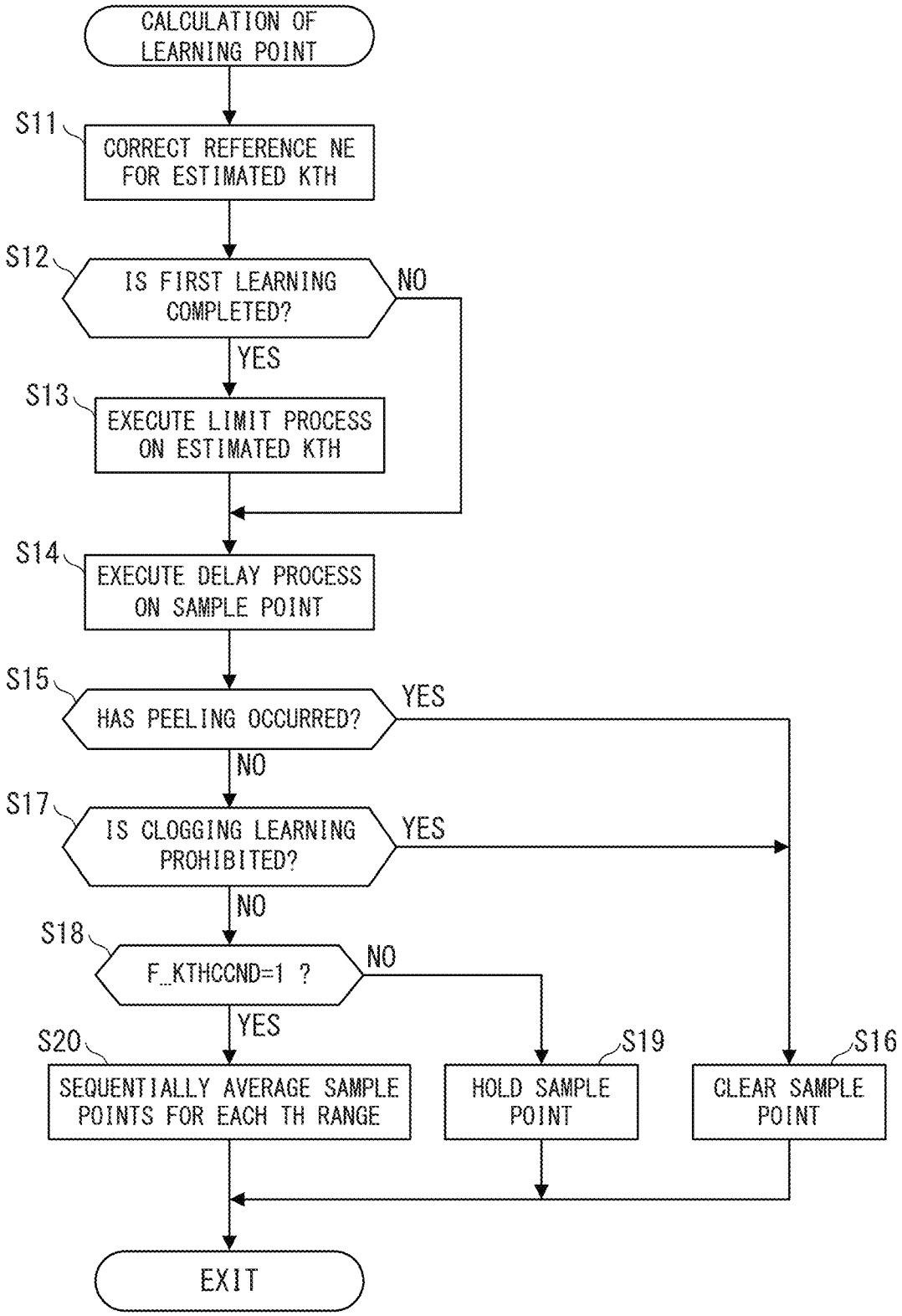
FIG. 5 is a flowchart illustrating the process of calculating the learning points.

On the other hand, when the answer to step 3 is YES and clogging learning is permitted, processing proceeds to step 5 to calculate learning points. FIG. 5 illustrates the calculation process. In this process, first, in step 11, NE (RPM) is corrected for the sample points (estimated KTH) obtained in step 1. This NE correction takes into account the characteristic that the estimated KTH becomes larger as the engine speed NE increases, and is executed, for example, as follows (see FIGS. 6A and 6B).

Figure 6A:
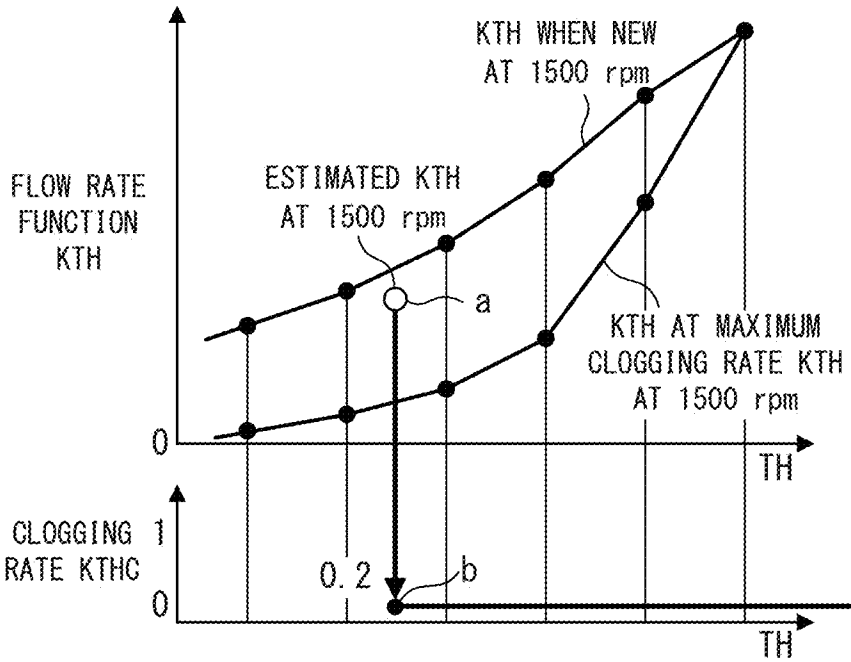
FIGS. 6A and 6B are diagrams for explaining the RPM correction method for the sample points (estimated KTH)

FIG. 6A illustrates an example when the current NE (current engine speed) is 1500 rpm, and the estimated KTH at the current NE is calculated in step 1 (point a in FIG. 6A).

Next, using the calculated estimated KTH at the current NE, KTH when new and KTH at maximum clogging at the current NE, the clogging rate KTHC is calculated by the above equation (2) (point b (for example, 0.2)).

Figure 6B:
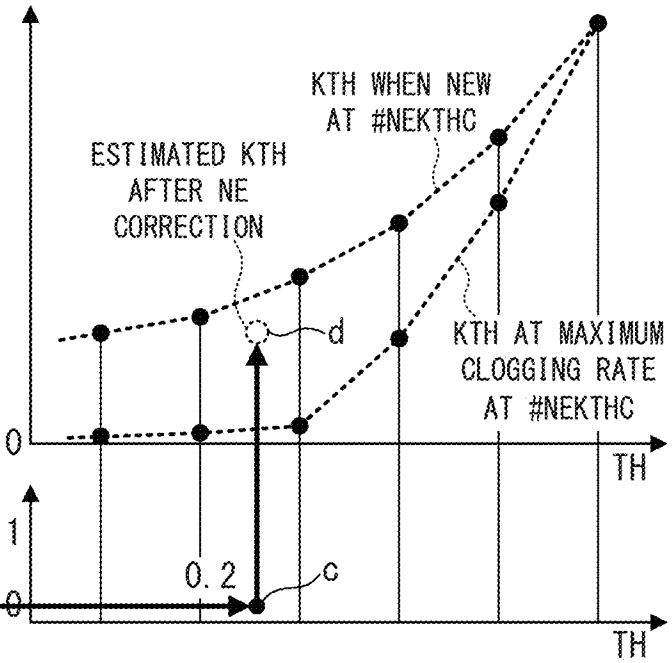

Next, as illustrated in FIG. 6B, while maintaining the clogging rate KTHC at the current NE (point c), the estimated KTH at the current NE is converted to the estimated KTH at the reference RPM #NEKTHC by the following equation (3), using KTH when new and KTH at maximum clogging at the predetermined reference RPM #NEKTHC (point d).

$$\text{Estimated } KTH=(1-KTHC)\times KTH \text{ when new}+KTHC\times KTH \text{ at maximum clogging} \quad (3)$$

The reference RPM #NEKTHC is the predetermined engine speed serving as a reference of NE correction, and the equation (3) is the expression of the equation (2) above for the estimated KTH. As a result of the above NE correction, the estimated KTH obtained at different engine speeds NE can be converted uniformly to the estimated KTH at the reference RPM NEKTHC while maintaining the clogging rate KTHC, thereby allowing good compensation for variations in the estimated KTH due to the engine speed NE.

Returning to FIG. 5, in step 12 following step 11, it is determined whether or not the first learning of the clogging rate KTHC has been completed. When the answer is NO, for example, if this time corresponds to the first operation cycle after the ECU 2 is replaced and thus the current clogging learning corresponds to the first learning, the process directly proceeds to step 14 described later.

Figure 7:
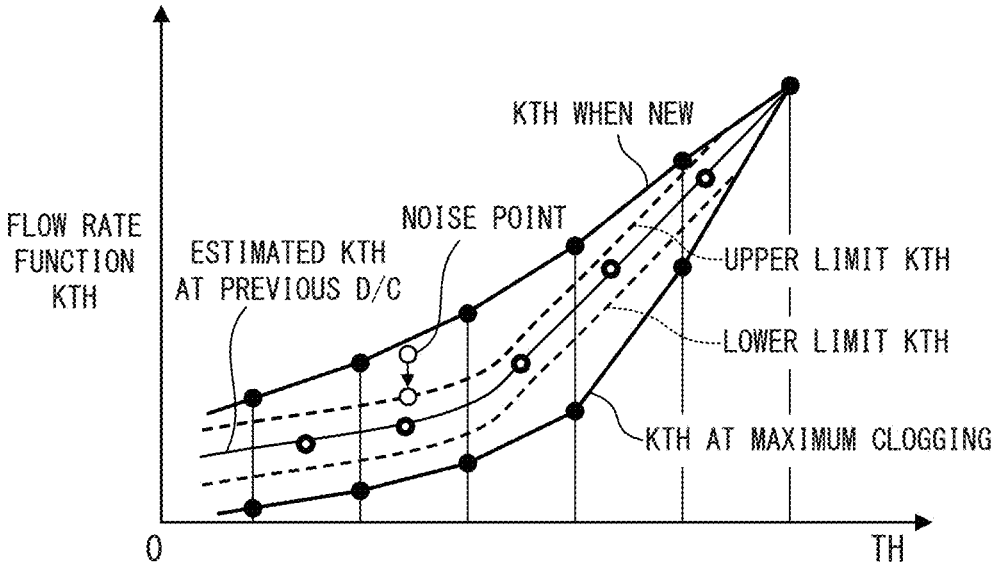
FIG. 7 is a diagram for explaining the method of limiting the sample points (estimated KTH) to within an acceptable range when the sample points (estimated KTH) are noise points with a large error.

On the other hand, when the answer to step 12 is YES and the current clogging learning corresponds to after the first learning, the process of limiting the estimated KTH is executed in step 13. This limiting process is used to limit the estimated KTH corrected in step 11 to within an acceptable range when it is a noise point with a large error, and is executed as follows, for example (see FIG. 7).

First, the upper and lower limit KTHs are set by adding and subtracting a predetermined tolerance (for example, 8% of the estimated KTH) to and from the estimated KTH characteristic obtained in the previous operation cycle (D/C).

Next, when the current estimated KTH is out of the acceptable range defined by the upper and lower limit KTHs, this estimated KTH is set to the upper or lower limit KTH, which is outside the acceptable range, to limit it as a noise point with a large error.

As described above, when the estimated KTH is a noise point with a large error, the estimated KTH is limited by the upper or lower limit KTH, thus reducing the influence of variation in the estimated KTH and improving the accuracy of the learning points and the learning accuracy of the clogging rate KTHC.

Returning to FIG. 5, when the answer to step 12 is NO and the current clogged learning corresponds to the first learning, or in step 14 following step 13, the delay process for the sample points is executed. The sample points in this case include a combination of the throttle valve position TH and the estimated KTH corrected and/or limited in steps 11 and 13.

The purpose of this delay process is as follows. For example, in a case where the condition of the clogging learning fails as the throttle valve position TH increases from the stable state (hereinafter referred to as "when leaving the learning condition"), immediately before the failure, the estimated KTH changes with respect to the throttle valve position TH with a delay, and the relationship between the two is shifted from the relationship in the stable state, which may reduce the learning accuracy of the clogging rate KTHC calculated based on this relationship. In consideration of the above points, when calculating the learning points during leaving the learning condition, the sample points obtained immediately before that time are excluded, and a delay process is executed for this purpose.

This delay process is executed using, for example, a ring buffer in the RAM of the ECU 2. Specifically, in step 14, the sample points (TH, estimated KTH) obtained this time are stored in the buffer of number 1 of the ring buffer (number of buffers=N), and at the same time, the sample points stored in the buffer of number n are shifted to the buffer of number n+1. By repeating this process, the buffer with the maximum number N stores the sample points obtained a predetermined amount of time (execution interval of this process x (N−1)) before the current time. Therefore, by reading the sample points from the buffer of number N, the process can be delayed for a predetermined time, ensuring that the sample points obtained within the preceding predetermined time are excluded during leaving the learning condition.

Returning to FIG. 5, in step 15 following step 14, it is determined whether or not "peeling" from a throttle valve 5 (separation of deposits from the opening of the throttle valve 5) has occurred. In the determination of the peeling, for example, when the difference between the current value of the estimated KTH calculated in step 1 of FIG. 2 and the previous value is greater than a predetermined value for determination, it is determined that peeling has occurred due to the rapid decrease in the estimated KTH.

When the answer to step 15 is YES and it is determined that peeling has occurred, the estimated KTH calculated up to that point is presumed to be unreliable, so the stored sample points are cleared in step 16.

On the other hand, when the answer to step 15 is NO, in step 17, it is determined whether or not clogging learning is prohibited by, for example, detecting abnormalities in sensors such as the throttle valve position sensor 21 and the EGR valve position sensor 27. When the answer is YES, processing proceeds to step 16 to clear the sample points because the estimated KTH calculated up to that point may be inaccurate due to low detection accuracy of the sensors.

On the other hand, when the answer to step 17 is NO, that is, no peeling has occurred and learning is not prohibited due to the detection of an abnormality in the sensors such as the throttle valve position sensor 21, in step 18, it is determined whether or not the learning permission flag F_KTHCCND is "1". When the answer is NO and clogging learning is not permitted, processing proceeds to step 19 to hold the sample points at the previous sample points without calculating the learning points.

On the other hand, when the answer in step 18 is YES and the clogging learning is permitted, in step 20, the learning points are calculated by sequentially averaging the plurality of sample points for each position range of the throttle valve 5.

The reason for sequentially averaging the sample points in this manner is to reduce the memory capacity as follows. First, when there is a plurality of data values (x (1) . . . x (n), x (n+1)), the average value xave (n+1) is calculated by the following equation.

$$xave(n+1)=(x(1)+\ldots+x(n)+x(n+1))/(n+1) \quad (4)$$

$$=(n\cdot(x(1)+\ldots+x(n))/n+x(n+1))/(n+1)=(n\cdot xave(n)+x(n+1))/(n+1) \quad (5)$$

The equation (4) is a general calculation formula that uses all data values (x(1) to x(n+1)) to collectively calculate the average value xave(n+1). In this case, all data values must be stored in order to calculate the average value xave(n+1). Therefore, when the number of sample points used to calculate the average of sample points is very large, the required memory space may become enormous.

In contrast, the equation (5) above calculates the current average value xave(n+1) sequentially from the previous average value xave(n) and the current data value x(n+1). In this case, the calculation of the average value xave(n+1) does not require the storage of all data values, but only the average value xave(n) up to the previous time, the number of data n, and the current data value x(n+1). Therefore, using such sequential calculations for averaging sample points significantly reduces the memory capacity, regardless of the number of sample points.

Figure 8:
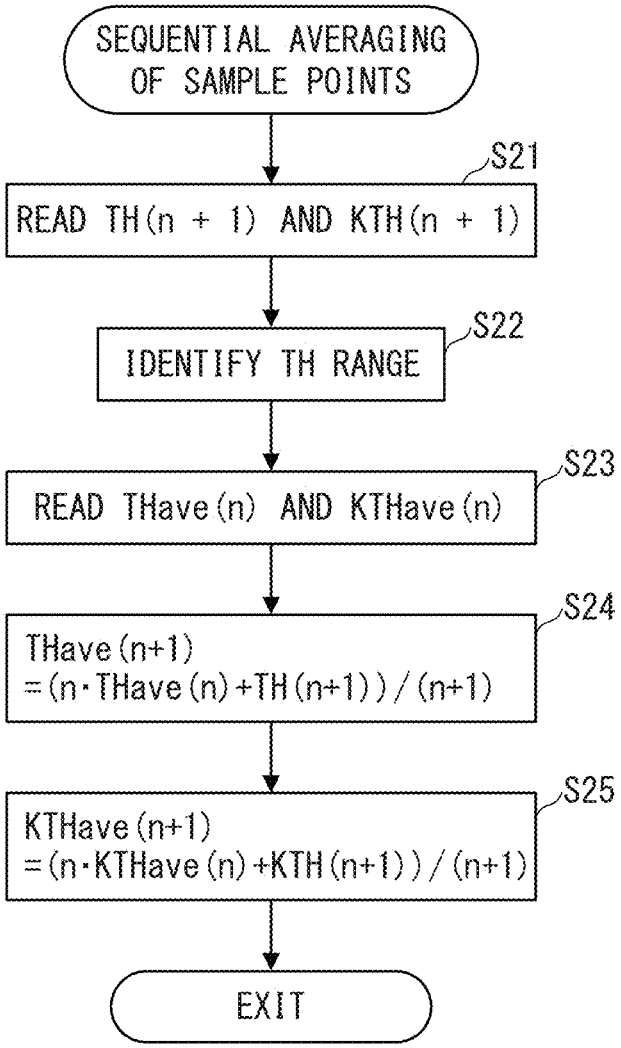
FIG. 8 is a flowchart illustrating the process of sequentially averaging sample points.

FIG. 8 illustrates the sequential averaging process of sample points executed in step 20. In this process, first, in step 21, the throttle valve positions TH(n+1) and KTH(n+1), which are current sample points, are read from the ring buffer in the RAM. Next, the TH range to which the read throttle valve position TH(n+1) belongs is identified (step 22). Next, the average throttle valve position THave(n) up to the previous time, the estimated KTH average value KTHave(n), and the number of sample points n stored for the identified TH range are read (step 23).

Next, using the above parameters, the average throttle valve position THave(n+1) and the average KTH KTHave (n+1) are calculated by the following equations (6) and (7) based on the above equation (5), respectively (steps 24 and 25).

$$THave(n+1)=(n\cdot THave(n)+TH(n+1))/(n+1) \quad (6)$$

$$KTHave(n+1)=(n\cdot KTHave(n)+KTH(n+1))/(n+1) \quad (7)$$

Figure 4:
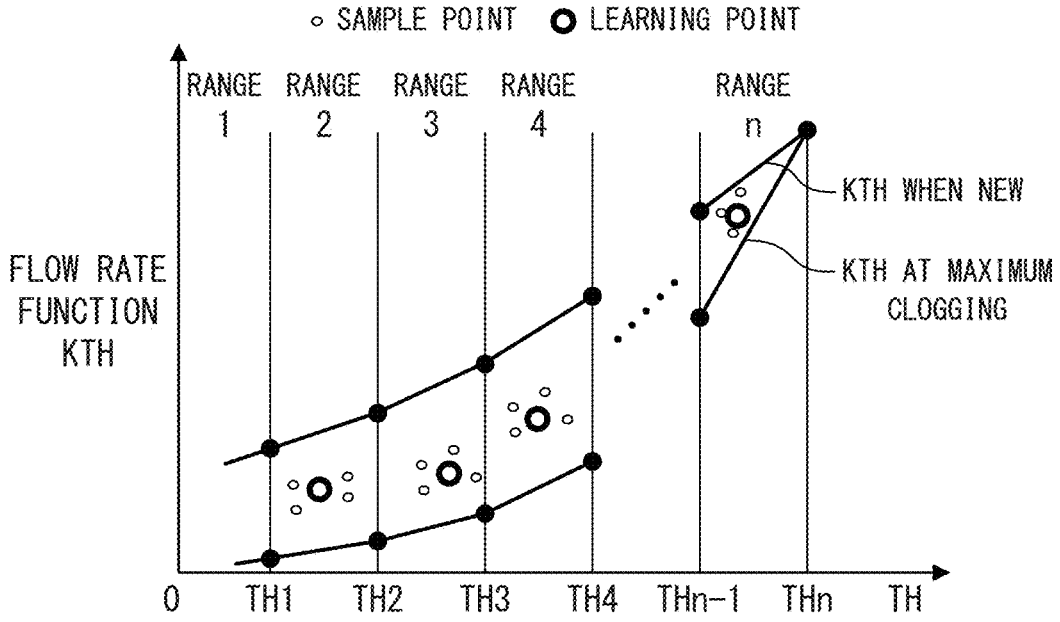
FIG. 4 is a diagram for explaining the relationship between the throttle valve position range, sample points, and learning points.

Then, by repeating the above process with the learning conditions satisfied, one learning point (THave, KTHave), which is a combination of THave and KTHave values, is finally calculated for each TH range (see FIG. 4).

Returning to FIG. 2, after the learning points are calculated in the normal operation mode as described above, in the right-after-stop mode when the ignition switch 31 is turned off, the learning prohibited range is first set in step 6. The purpose thereof is as follows. For example, as the throttle valve 5 is used and clogging progresses, the throttle valve 5 is controlled to the high position side so as to compensate for the shortage of the intake air volume due to the clogging, whereby the use frequency in the low TH range may become 0. In this case, the number of sample points in the low TH range will be zero, which not only reduces the learning accuracy of the learning points in the low TH range, but may also adversely affect the learning accuracy of the clogging rate KTHC in other TH ranges. For this reason, learning in the low TH range is prohibited.

Figure 9:
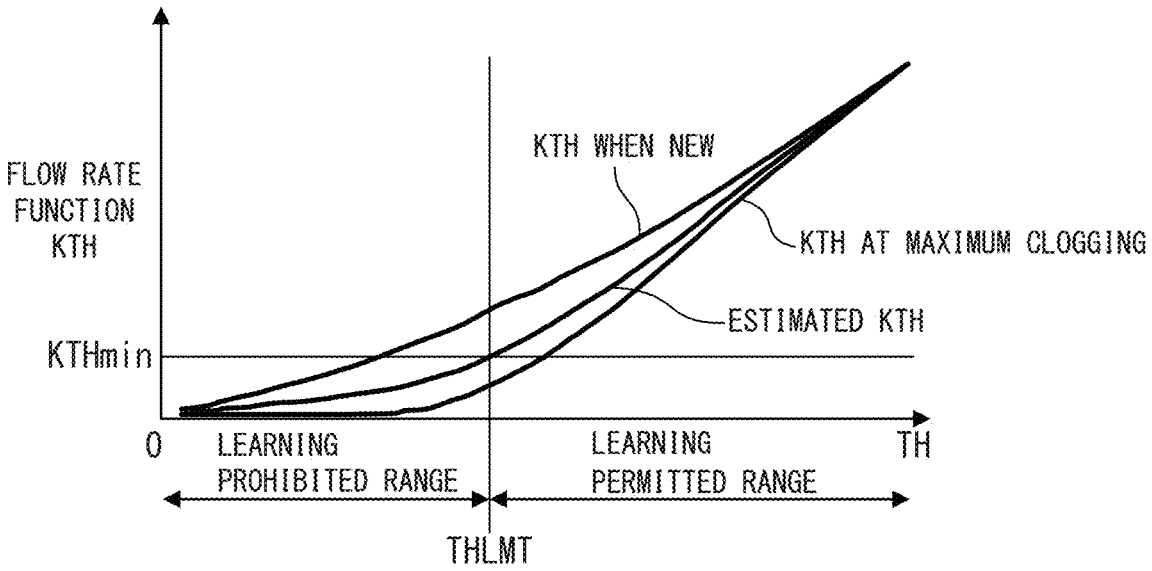
FIG. 9 is a diagram for explaining the method of setting a learning prohibited range on the low position side of the throttle valve.

The learning prohibited range is set, for example, as illustrated in FIG. 9. First, the throttle valve position TH corresponding to the intersection of the line representing the predetermined lower KTH limit KTHmin, which corresponds to the limit of use on the low flow rate side of the flow rate function, and the line representing the estimated KTH characteristics based on a plurality of learning points obtained in the preceding normal operation mode is determined as the lower limit of learning position THLMT. The TH range to which the lower limit of learning position THLMT belongs and the TH range on the lower position side are set as the learning prohibited range, and the TH range on the higher position side than the learning prohibited range is set as the learning permitted range.

Figure 15:
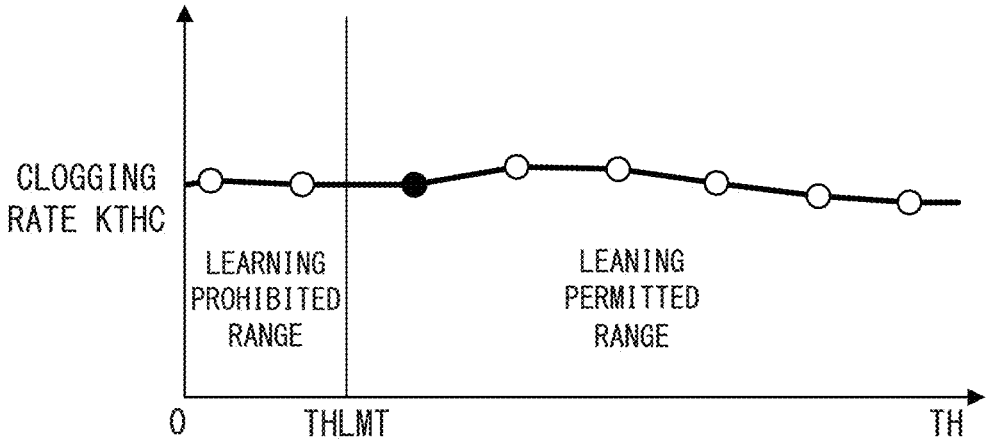
FIG. 15 is a diagram for explaining the method of setting the clogging rate when a learning prohibited range on the low position side is set.

When such range setting is executed, the approximation of the estimated KTH characteristic by the approximate function based on the learning points and the learning of the clogging rate KTHC based on the estimated KTH characteristic are prohibited in the learning prohibited range and executed only in the learning permitted range. In this case, as illustrated in FIG. 15, the clogging rate KTHC in each TH range of the learning prohibited range is set to the same value as the clogging rate KTHC in the learning permitted range adjacent to the learning prohibited range.

Returning to FIG. 2, in step 7 following step 6 in the right-after-stop mode, the coefficient of the approximate function is calculated. This approximate function approximates the estimated KTH characteristic, which represents the relationship of the estimated KTH with the throttle valve position TH, and the present embodiment uses the following second-order polynomial equation (8).

$$\text{Estimated } KTH = a \cdot TH^2 + b \cdot TH + c \quad (8)$$

Figure 10:
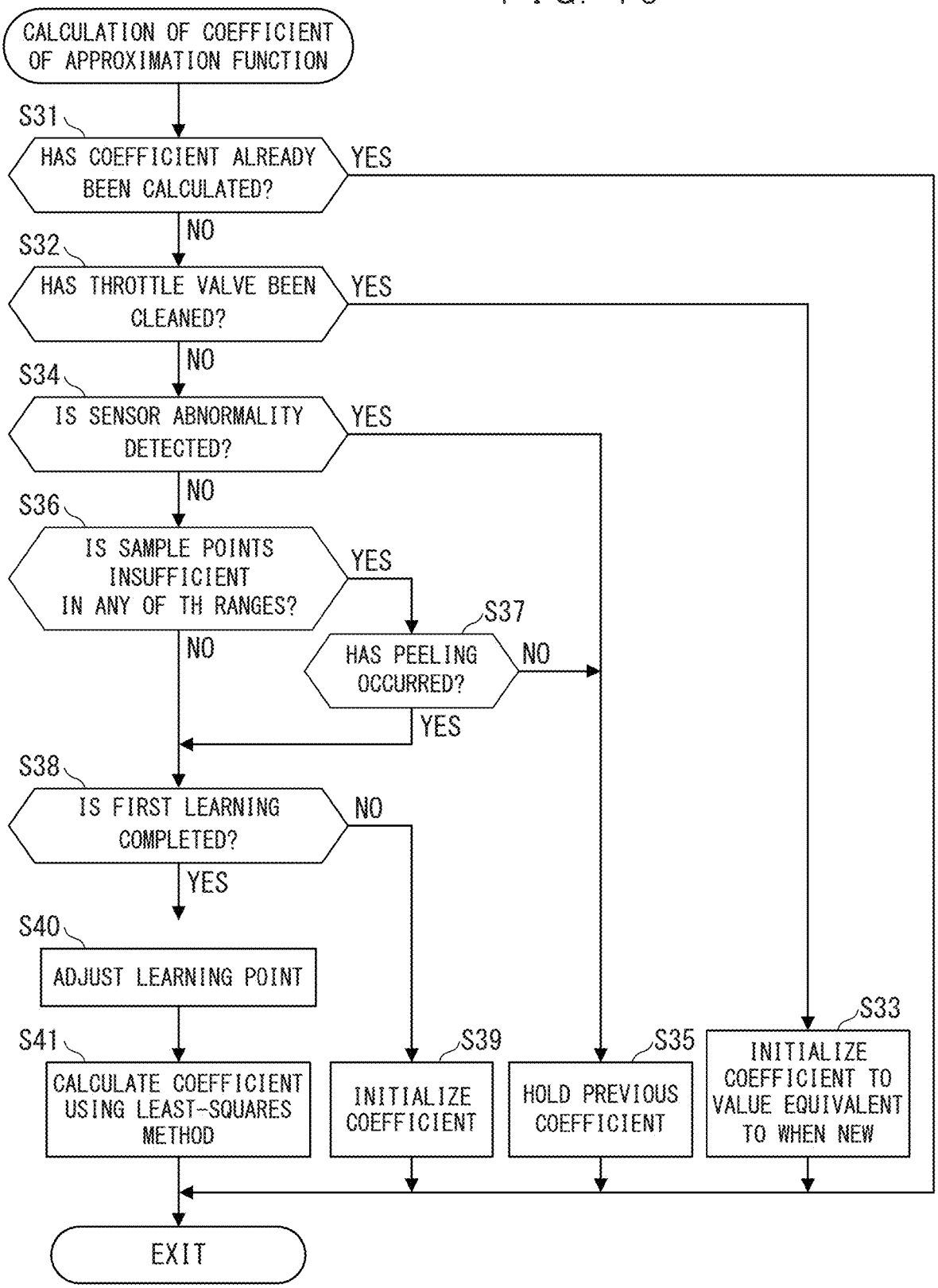
FIG. 10 is a flowchart illustrating the process of calculating the coefficients of an approximate function.

FIG. 10 illustrates the process of calculating these coefficients. As described later, this process calculates (identifies) the coefficients a to c of the approximate function and updates the approximate function based on the plurality of learning points calculated for each TH range when the predetermined conditions are satisfied, and when the learning conditions are not satisfied, in principle, the coefficients a to c are not newly calculated but held or initialized.

In this process, first, in step 31, it is determined whether or not the coefficients a to c (hereinafter referred to as "coefficients" as appropriate) of the approximate function have already been calculated in the current right-after-stop mode. When the answer is YES, no further calculation of the coefficients is executed and this process is terminated as it is. That is, the coefficients are calculated only once in the right-after-stop mode.

When the answer to step 31 is NO, processing proceeds to step 32 to determine whether or not the throttle valve 5 has been cleaned in a service inspection or other procedure. In this determination, for example, the maximum value KTHCMAX is determined from the currently available plurality of clogging rates KTHC for each TH range, and when the determined maximum value KTHCMAX is smaller than a predetermined value, it is determined that cleaning has been performed. When the answer is YES, it is determined that the actual flow rate function is as good as new due to the cleaning of the throttle valve 5, and processing proceeds to step 33 to initialize the coefficients of the approximate function to the equivalent value when the throttle valve 5 is new.

When the answer to step 32 is NO, processing proceeds to step 34 to determine whether or not an abnormality is detected in the throttle valve position sensor 21 or other sensors. When the answer is YES, the coefficients are held at the previous value obtained in the previous operation cycle in step 35, without calculating new coefficients, because the sample and learning points obtained in the previous normal operation mode may be less accurate due to the low detection accuracy of the sensors.

When the answer to step 34 is NO, it is determined whether or not the number of samples obtained in the current operation cycle is insufficient and less than a predetermined value in any of the TH ranges (step 36) and whether not peeling has occurred in the throttle valve 5 (step 37). As a result, when the number of sample points is insufficient in any TH range and no peeling has occurred, the learning points in any TH range may be inaccurate, so processing proceeds to step 35 and the coefficients are held at the previous values without calculating new ones.

On the other hand, in a case other than the above, that is, when the number of sample points is sufficient in at least some TH ranges or when peeling has occurred, processing proceeds to step 38 to determine whether or not the first learning of the clogging rate KTHC has been completed. When the answer is NO and the current clogging learning corresponds to the first learning, the number of reliable learning points may be insufficient, so processing proceeds to step 39 to initialize the coefficients to an appropriate predetermined value or the like without calculating new ones.

Figures 11A, 11B, 11C:
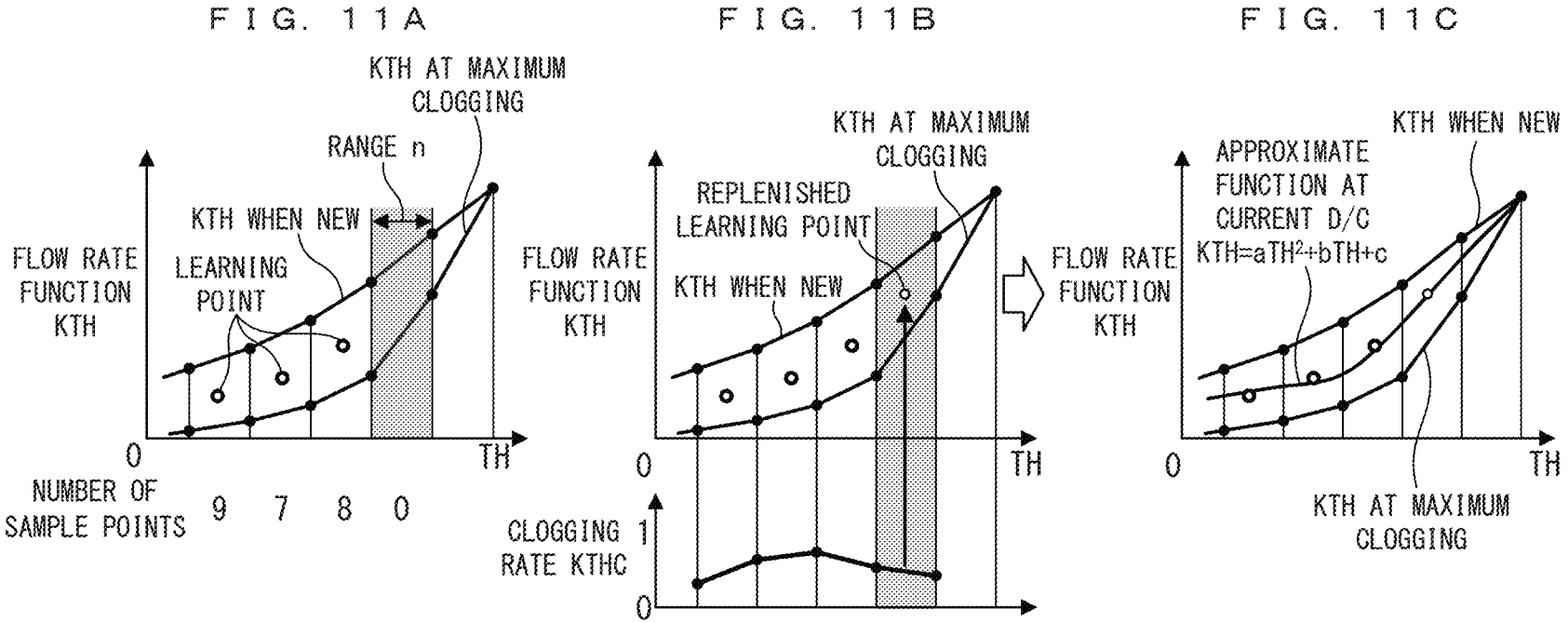
FIGS. 11A to 11C are diagrams for explaining the method of replenishing learning points in the throttle valve position range where no sample points have been obtained.

When the answer to step 38 is NO and the current clogging learning corresponds to the one after the first learning, processing proceeds to step 40 to adjust the number of learning points needed to calculate the coefficients. Specifically, as in the TH range n in FIG. 11A, since the number of sample points in the normal operation mode is 0, the learning point may not be calculated. In this case, as illustrated in FIG. 11B, the clogging rate KTHC at the throttle valve position TH at the center of that TH range is read from the clogging rate table learned in the previous operation cycle, and the estimated KTH is back-calculated from the clogging rate KTHC using the above equation (3). As a result, the learning points in that TH range are calculated and replenished to ensure the number of learning points needed to calculate the coefficients.

Returning to FIG. 10, in step 41 following step 40, the coefficients a to c of the approximate function in the equation (7), which approximates the estimated KTH characteristic, are calculated. Specifically, as illustrated in FIG. 11C, the coefficients a to c of the approximate function are calculated (identified) by the least-squares method based on a plurality of learning points for each TH range. As a result, the approximate function is updated. When a learning prohibited range is set in step 6 in FIG. 2, the coefficients a to c are calculated based only on the learning points in the learning permitted range, excluding the learning prohibited range.

Returning to FIG. 2, after the coefficients of the approximate function are calculated in the right-after-stop mode as described above, the clogging rate KTHC is calculated in step 8 in the initial operation mode of the next operation cycle in which the ignition switch 31 is turned on.

Figure 12:
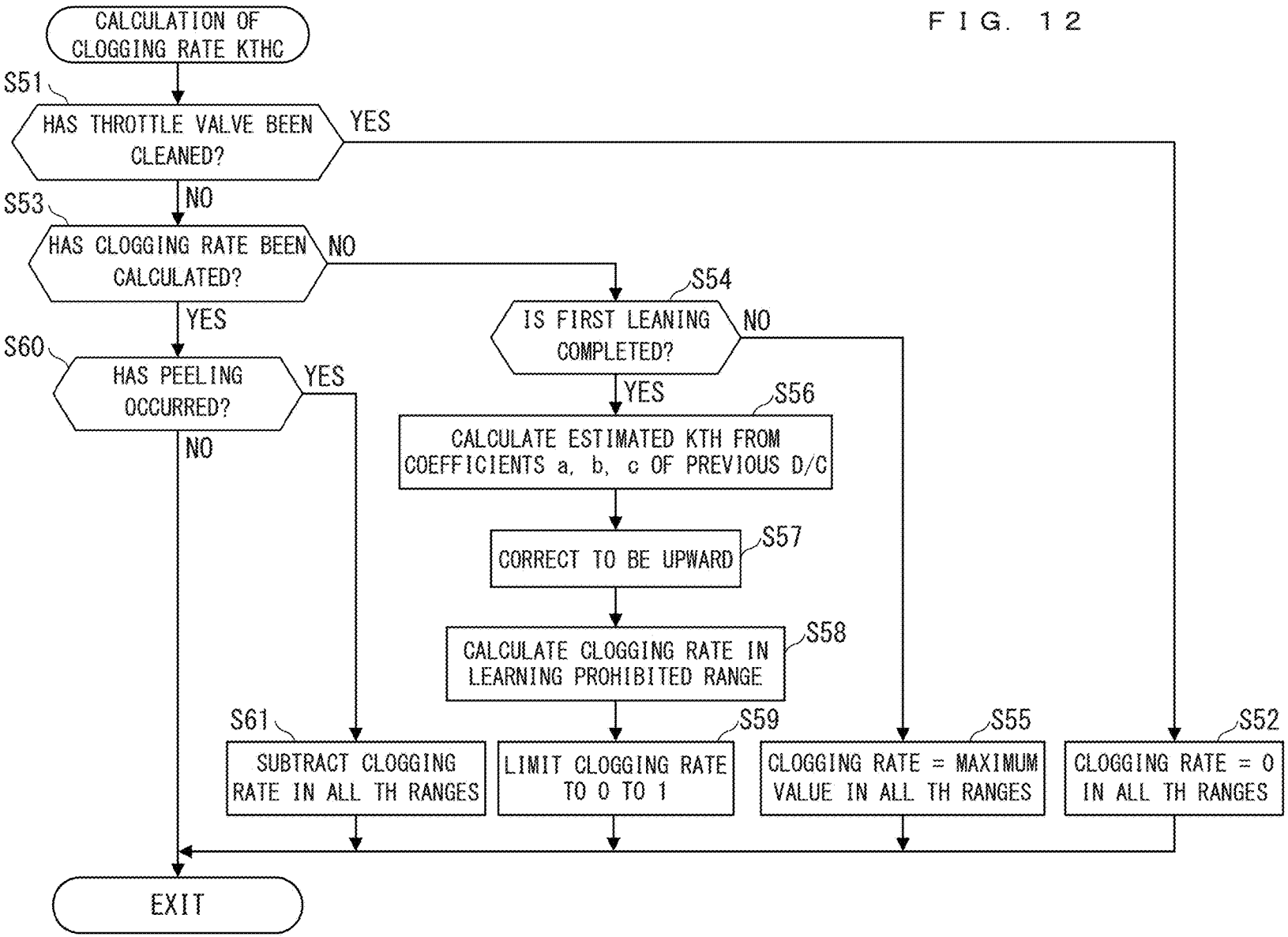
FIG. 12 is a flowchart illustrating the process of calculating a coefficient of an approximate function.

FIG. 12 illustrates the calculation process. In this process, first, in step 51, it is determined whether or not the throttle valve 5 has been cleaned in the previous operation cycle. When the answer is YES, it is determined that the degree of clogging of the throttle valve 5 is as good as new due to cleaning, and processing proceeds to step 52 to set the clogging rate KTHC of all TH ranges to 0, and this process is terminated.

When the answer to step 51 is NO, processing proceeds to step 53, and it is determined whether or not the clogging rate KTHC has already been calculated in the current initial operation mode. When the answer is NO, processing proceeds to step 54, and it is determined whether or not the first learning of the clogging rate KTHC has been completed. When the answer is NO and the current clogging learning corresponds to the first learning, highly reliable learning points may be insufficient, so processing proceeds to step 55 to set the clogging rate KTHC in all TH ranges to the maximum value, and this process is terminated.

Figure 13A:
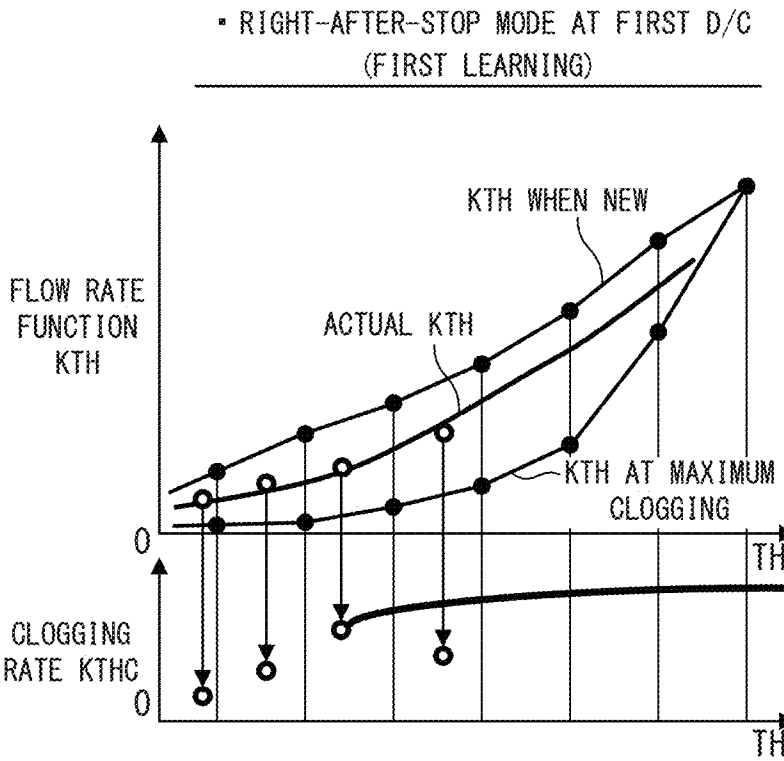
FIGS. 13A and 13B are diagrams for explaining the method of setting the clogging rate for the first learning.
Figure 13B:
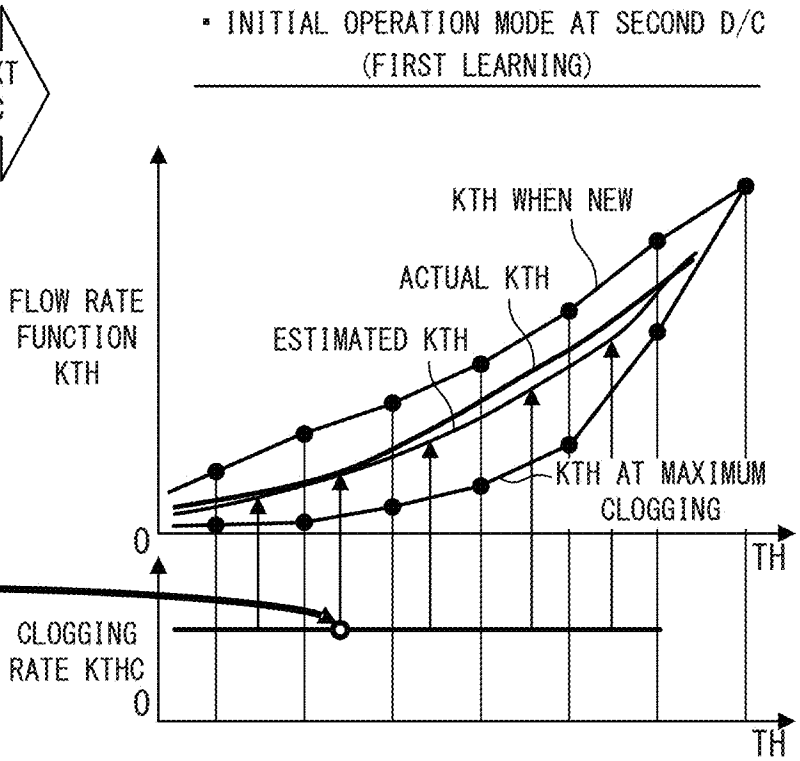

Specifically, as illustrated in FIG. 13A, the clogging rate KTHC is calculated from a plurality of learning points for each TH range obtained in the right-after-stop mode in the previous operation cycle. Next, the maximum value among the calculated clogging rates KTHC is set as the uniform clogging rate KTHC in all TH ranges. Thus, by estimating a larger clogging rate KTHC only at the first learning time, the position of the throttle valve 5 is controlled to a larger side to compensate for it, and the intake air volume can be controlled to an increasing side, which is safer from the viewpoint of exhaust gas characteristics and other factors.

Returning to FIG. 12, when the answer to step 54 is YES and the current clogging learning corresponds to after the first learning, processing proceeds to step 56 to calculate the estimated KTH by applying the coefficients a to c calculated in the right-after-stop mode of the previous operation cycle to the approximate function in the equation (8) above.

Next, in step 57, the estimated KTH characteristic approximated by the approximate function is corrected to be upward. This upward rightward correction is made in consideration of the fact that the estimated KTH characteristic inherently has an upward rightward characteristic due to the nature of the flow rate function, and that, in a case where the estimated KTH characteristic is downward rightward, for example, when the target throttle valve position is obtained on the basis of the estimated KTH characteristic, there is a possibility of occurrence of control hunting such as presence of a plurality of solutions.

Figure 14:
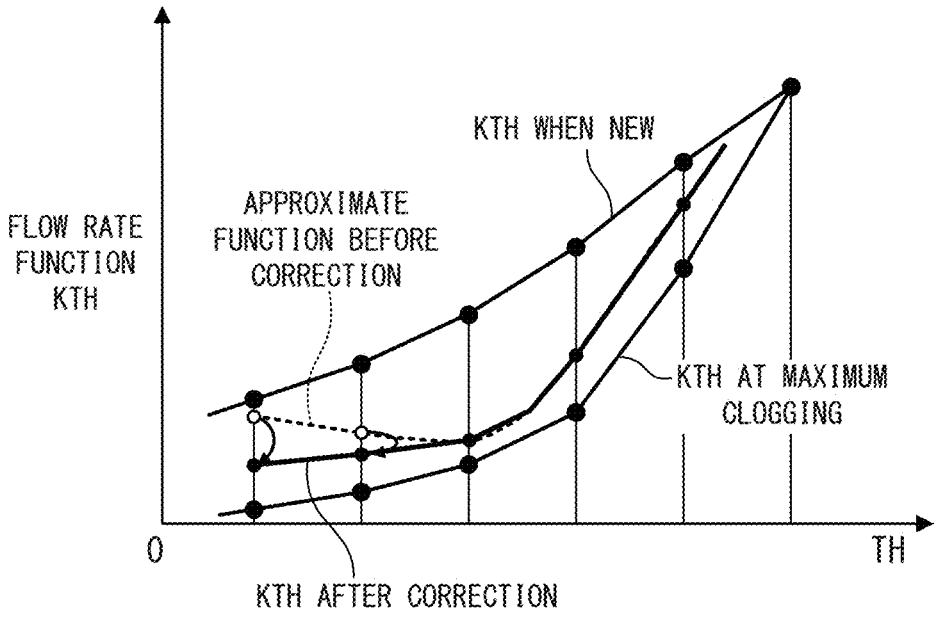
FIG. 14 is a diagram for explaining the method of correcting the estimated KTH characteristic upward.

Specifically, in a case where the estimated KTH characteristic has a downward portion as illustrated by the dotted line in FIG. 14, this downward portion is corrected to be upward with respect to the high position side and its slope is minimized, as indicated by the solid line. As a result, the estimated KTH characteristic is appropriately upward and the control hunting described above can be avoided.

Next, in step 58, the clogging rate KTHC in the learning prohibited range is calculated. This process is executed when the learning prohibited range is set in step 6 in FIG. 2, and approximation of the estimated KTH characteristic by an approximate function based on learning points and calculation of the clogging rate KTHC are prohibited in the learning prohibited range. In this case, as illustrated in FIG. 15, the clogging rate KTHC in each TH range of the learning prohibited range is set to the same value as the clogging rate KTHC (black circle in the figure) obtained in the TH range closest to the learning prohibited range in the learning permitted range. As a result, the clogging rate KTHC can be set without any trouble in the learning prohibited range where no sample points are obtained.

Next, in step 59, the clogging rate KTHC calculated so far is limited to the range of values 0 to 1, and this process is terminated.

Figure 16A:
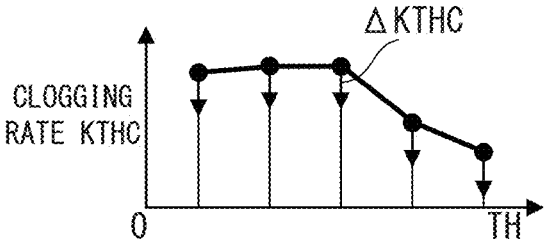
FIGS. 16A and 16B are diagrams for explaining the method of setting the clogging rate when peeling has occurred in the throttle valve.
Figure 16B:
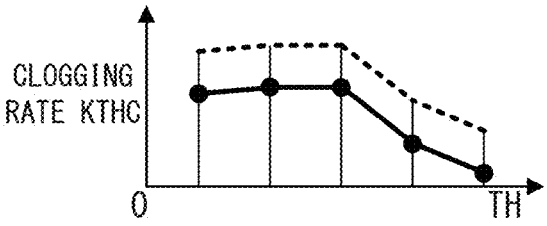

On the other hand, when the answer to step 53 is YES and the clogging rate KTHC has already been calculated, processing proceeds to step 60 to determine whether or not peeling from the throttle valve 5 has occurred in the previous operation cycle. When the answer is YES, it is estimated that the clogging rate KTHC is decreasing rapidly over all TH ranges due to the occurrence of peeling. Therefore, processing proceeds to step 61, where the clogging rate KTHC of each TH range is uniformly subtracted by a predetermined amount ΔKTHC, as illustrated in FIGS. 16A and 16B. As a result, false learning of the clogging rate KTHC caused by peeling can be avoided and the peeling rate KTHC can be set favorably.

When the answer to step 60 is NO, that is, when the clogging rate KTHC has already been calculated and no peeling from the throttle valve 5 has occurred, it is determined that no further calculation of the clogging rate KTHC is executed, and the process is terminated as it is. That is, the calculation of the clogging rate KTHC is executed only once in the initial operation mode.

Figure 17:
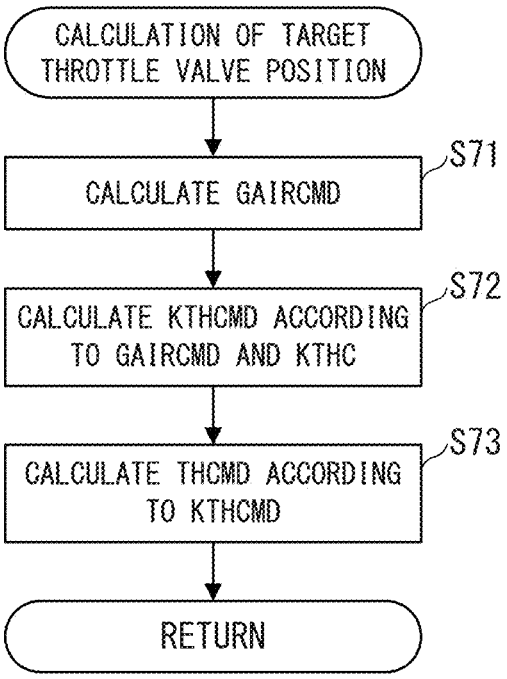
FIG. 17 is a flowchart illustrating the process of calculating the target throttle valve position.

Next, with reference to FIG. 17, the processing of calculating the target throttle valve position is described. This processing uses the clogging rate KTHC calculated in the initial operation mode of the current operation cycle, and is executed every predetermined time in the normal operation mode thereafter.

In this process, first, the target intake air volume GAIRCMD is calculated in step 71. The calculation is executed, for example, by searching a predetermined map (not illustrated) according to the detected engine speed NE and the required torque TRQ. The required torque TRQ is calculated by searching a predetermined map (not illustrated) according to the engine speed NE and the detected gas pedal position AP.

Figure 18:
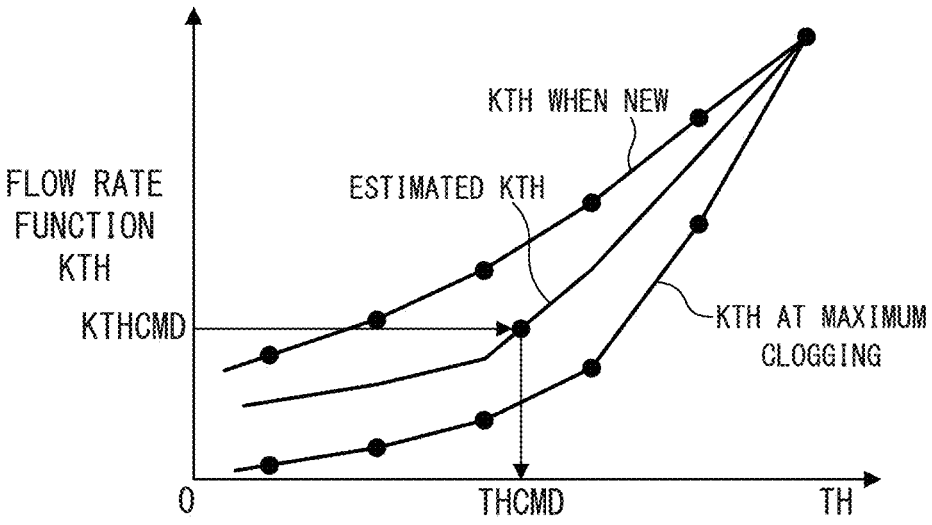
FIG. 18 is a diagram for explaining the method of setting the target throttle valve position according to the target flow rate function.

Next, in step 72, the target flow rate function KTHCMD is calculated by searching a predetermined map (not illustrated) according to the target intake air volume GAIRCMD and the clogging rate KTHC. Finally, in step 73, as illustrated in FIG. 18, the target throttle valve position THCMD is calculated from the target flow rate function KTHCMD and the estimated KTH characteristic, and this process is terminated. This allows the target throttle valve position THCMD to be set appropriately while reflecting the throttle valve 5 clogging rate KTHC.

As described above, according to the present embodiment, the learning points are calculated by averaging a plurality of sample points, which combines the throttle valve position TH and the estimated KTH, for each of the predetermined plurality of TH ranges of the throttle valve 5, This reduces the computational load and memory capacity compared to the conventional case where the representative point of the estimated KTH is calculated by the least-squares method for each TH range. In addition, the coefficients a to c of the approximate function of the polynomial equation that approximates the estimated KTH characteristics are calculated by the least-squares method based on a plurality of learning points calculated for a plurality of TH ranges, and the clogging rate KTHC is calculated based on the estimated KTH characteristic approximated by the approximate function, KTH when new, and KTH at maximum clogging. This allows accurate leaning of the clogging rate KTHC of the throttle valve 5 over a wide TH range.

As illustrated in FIG. 8, since the learning points are calculated by sequentially averaging the sample points each time a sample point is obtained, it is only necessary to sequentially store the previous sample points and the sample point average, regardless of the number of sample points. As a result, the memory capacity can be greatly reduced compared to the conventional case where a large number of sample points are all stored and averaged together.

Furthermore, as illustrated in FIG. 2, the calculation of the learning points, calculation of the coefficients a to c of the approximate function, calculation of the clogging rate KTHC, and control of the engine 3 are executed in the normal operation mode, right-after-stop mode, next initial operation mode, and normal operation mode of the engine 3, respectively. As a result, the processing load can be reduced by distributing and executing these calculation and control processes in each operating mode. In addition, the only data that needs to be passed between the operation modes of the engine 3 are basically: a plurality of learning points for each TH range between the normal operation mode and right-after-stop mode; the coefficients a to c of the approximate function between the right-after-stop mode and next initial operation mode; and the clogging rate KTHC between the initial and normal operation modes. Therefore, these data can be easily stored and passed on with a very small memory capacity.

As illustrated in FIGS. 11A to 11C, when there is a TH range where the number of sample points obtained in the current operation cycle is 0, the coefficients a to c of the approximate function are calculated using the learning points calculated in the previous operation cycle. As a result, the accuracy of the approximation by the approximate function based on a plurality of learning points and the learning accuracy of the clogging rate KTHC based on it can be favorably maintained.

Furthermore, as illustrated in FIGS. 9 and 15, when there is a low TH range that is not used during operation of the engine 3, this low TH range is set as a learning prohibited range and learning of the clogging rate KTHC is prohibited. As a result, the accuracy of the clogging rate KTHC can be favorably maintained by using the learning points obtained in the learning permitted range and executing approximation with an approximate function only for the learning permitted range. The clogging rate KTHC for the learning prohibited range can be set without any trouble by setting it to the same value as the clogging rate KTHC calculated in the TH range adjacent to the learning prohibited range.

When the estimated KTH characteristic approximated by the approximate function has a downward portion, as illustrated in FIG. 14, this downward portion is corrected so that it is upward. As a result, the estimated KTH characteristic becomes appropriately upward, and control hunting can be avoided in cases such as setting the target throttle valve position according to the estimated KTH characteristic.

Further, as illustrated in FIGS. 6A and 6B, the calculated estimated KTH is corrected with respect to the predetermined reference RPM #NEKTHC and then obtained as a sample point. As a result of this correction, the estimated KTH calculated under different engine speed NE conditions can be converted uniformly to the value at the reference RPM #NEKTHC, thereby allowing good compensation for variations in the estimated KTH due to the engine speed NE.

In addition, as illustrated in FIGS. 16A and 16B, the clogging rate KTHC is corrected uniformly to the decreasing side, regardless of the throttle valve position TH, when it is determined that peeling of deposits from the throttle valve 5 has occurred. As a result, the clogging rate KTHC can be appropriately corrected in response to the peeling of deposits from the throttle valve 5.

The present invention is not limited to the embodiment described above and may be implemented in various aspects. For example, in the embodiment, as illustrated in FIG. 11A to 11C, when the number of sample points obtained in the current operation cycle is 0, the learning points calculated in the previous operation cycle are supplemented as learning points in that TH range, but this supplementation of learning points may be executed when the number of sample points in the current cycle is very small, less than a predetermined value (for example, 3) near 0.

In this embodiment, the learning prohibited range where clogging learning is prohibited is set in the lower TH range. However, when a situation in which the use frequency of the throttle valve 5 becomes 0 occurs in the higher TH range, the higher TH range may be set as a learning prohibited range. In this case, the learning points obtained in the learning permitted range other than the higher TH range are used, and the clogging learning can be executed accurately only for the learning permitted range, and the clogging rate KTHC in the higher TH range is set to the same value as the clogging rate KTHC of the adjacent TH range.

In this embodiment, the clogging rate KTHC defined by the equation (2) is used as a clogging parameter to represent the degree of clogging of the throttle valve 5. However, other suitable parameters, such as the deposition rate or amount of deposits at the opening of the throttle valve 5, may be used as long as they represent the degree of clogging of the throttle valve 5.

In this embodiment, the target throttle valve position THCMD is set as a control of the engine 3 using the clogging rate KTHC of the throttle valve 5. However, the clogging rate KTHC may be used to control the intake air volume and fuel injection or to estimate the intake air volume. In addition, the configuration of the details can be appropriately changed within the scope of the present invention.

What is claimed is:

1. A control apparatus for an internal combustion engine comprising:

a clogging parameter calculation means that calculates a clogging parameter that represents the degree of clogging of a throttle valve using a first flow rate function for a state where the degree of clogging of the throttle valve in an intake air passage of the internal combustion engine is in the reference state and a second flow rate function estimated based on an intake air volume detected by an air flow meter; and a control means that controls the internal combustion engine using the calculated clogging parameter, wherein the clogging parameter calculation means includes:

a sample point acquisition means for obtaining sample points that calculates the second flow rate function and obtains sample points, which are combinations of the second flow rate function and the throttle valve position of the throttle valve, for each predetermined period during operation of the internal combustion engine;

a learning point calculation means that calculates learning points for each of a plurality of predetermined position ranges of the throttle valve by averaging the plurality of sample points belonging to the position ranges; and a coefficient calculation means that calculates coefficients of an approximate function of a predetermined polynomial equation for approximating a second flow rate function characteristic, which represents the relationship of the second flow rate function with the position of the throttle valve, by the least-squares method based on the plurality of learning points calculated for each of the plurality of position ranges, and the control apparatus calculates the clogging parameter based on the second flow rate function characteristic approximated by the approximate function using the calculated coefficients and on the first flow rate function.

2. The control apparatus for an internal combustion engine according to claim 1, wherein the learning point calculation means calculates the learning points by sequentially averaging the plurality of sample points each time the sample point is obtained.

3. The control apparatus for an internal combustion engine according to claim 2, wherein the learning point calculation means calculates the learning points in a normal operation mode of the internal combustion engine, the coefficient calculation means calculates the coefficients of the approximate function based on the plurality of learning points in a right-after-stop mode of the internal combustion engine, the clogging parameter calculation means calculates the clogging parameter based on the approximate function using the calculated coefficients in a next initial operation mode of the internal combustion engine, and the control means controls the internal combustion engine using the clogging parameter in a next normal operation mode of the internal combustion engine.

4. The control apparatus for an internal combustion engine according to claim 1, wherein the learning point calculation means calculates the learning point for each operation cycle of the internal combustion engine, and when there is a position range of the throttle valve for which the number of sample points obtained in a current operation cycle is less than a predetermined value, the coefficient calculation means uses the learning points calculated in a previous operation cycle as the learning points for the position range to calculate the coefficients of the approximate function.

5. The control apparatus for an internal combustion engine according to claim 4, wherein, when there is a lower or higher position range of the throttle valve that is not used during operation of the internal combustion engine, the clogging parameter calculation means sets the lower or higher position range as a learning prohibited range where learning of the clogging parameter is prohibited, and sets the clogging parameter in the learning prohibited range to the same value as the clogging parameter calculated in the position range adjacent to the learning prohibited range.

6. The control apparatus for an internal combustion engine according to claim 1, wherein, when the second flow rate function characteristic approximated by the approximate function has a downward portion, the clogging parameter calculation means corrects the downward portion to be upward.

7. The control apparatus for an internal combustion engine according to claim 1, wherein the sample point acquisition means corrects the calculated second flow rate function based on a predetermined reference speed, and then obtains it as the sample point.

8. The control apparatus for an internal combustion engine according to claim 1, further comprising a peeling determination means that determines whether or not peeling of deposits from the throttle valve has occurred, wherein the clogging parameter calculation means corrects the clogging parameter uniformly to the decreasing side, regardless of the position of the throttle valve, when it is determined that peeling has occurred.

* * * * *